United States Patent [19]

Giguère

[11] Patent Number: 4,513,536

[45] Date of Patent: Apr. 30, 1985

[54] WEATHER TIGHT SEAL FOR THE SILL OF A HOUSEHOLD DOOR

[75] Inventor: Jean-Paul Giguère, St-Agapit, Canada

[73] Assignee: Donat Flamanc Inc., St.-Apollinaire, Canada

[21] Appl. No.: 480,677

[22] Filed: Mar. 31, 1983

[30] Foreign Application Priority Data

Nov. 12, 1982 [CA] Canada ..... 415437

[51] Int. Cl.[3] ..... E06B 1/70

[52] U.S. Cl. ..... 49/470; 49/471

[58] Field of Search ..... 49/467, 468, 469, 470

[56] References Cited

U.S. PATENT DOCUMENTS

| | | | |
|---|---|---|---|
| 2,880,477 | 4/1959 | Kunkel | 49/470 |
| 2,976,584 | 3/1961 | Ghormley | 49/470 |
| 3,854,246 | 12/1974 | McAllister | 49/470 |
| 4,055,917 | 11/1977 | Ooller | 49/469 |

*Primary Examiner*—Kenneth Downey

*Attorney, Agent, or Firm*—Larson and Taylor

[57] ABSTRACT

A weather-tight seal for the sill of a household door, consisting of two extrusions preferably of a plastic material that is a poor conductor of heat, insuring great imperviousness due to the automatic adjustment of the bottom portion of the door, which is freely mounted, relative to the door sill. A horizontal flange enters into a bevelled and felted groove to guide the freely floating bottom edge of the door panel while, at the same time, a weather strip between the bottom of the door and the sill insures perfect imperviousness.

5 Claims, 2 Drawing Figures

WEATHER TIGHT SEAL FOR THE SILL OF A HOUSEHOLD DOOR

BACKGROUND OF THE INVENTION

Figure 1:
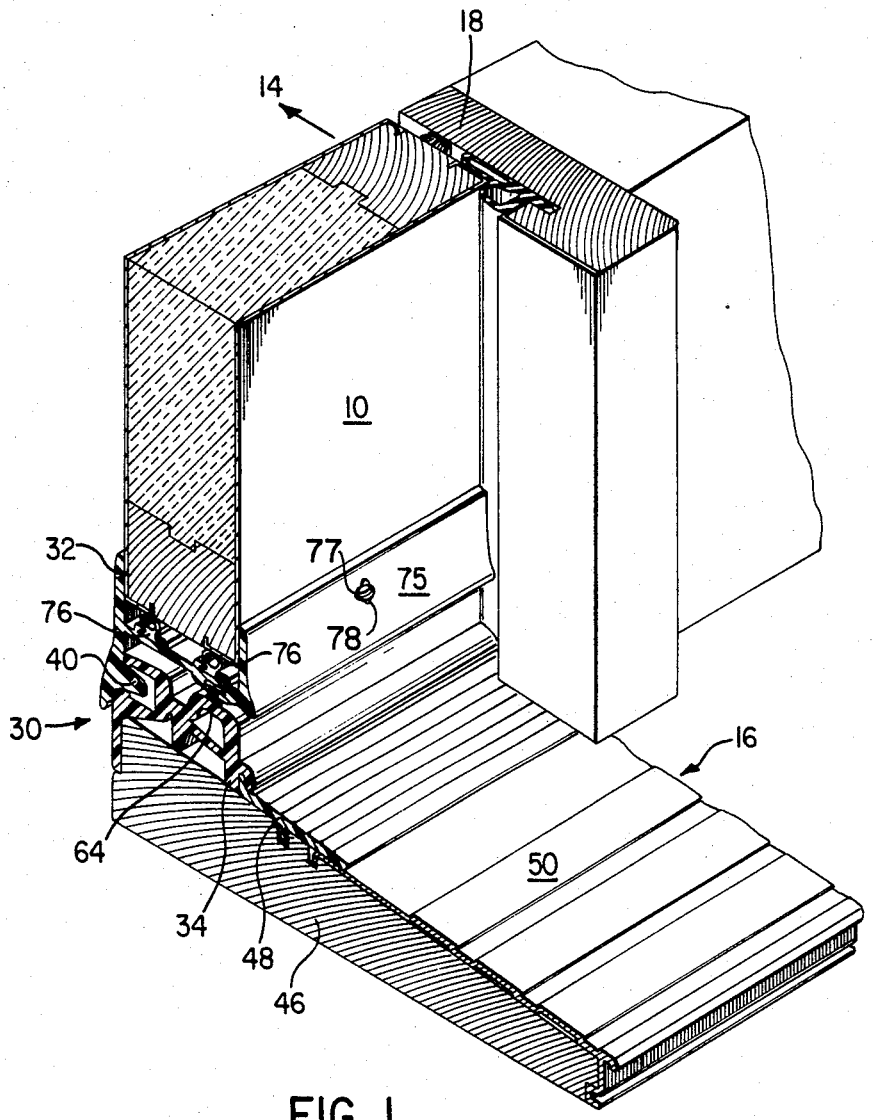

This invention relates to the construction of outdoor household doors and, more specifically, weather-tight seals for the sill of outdoor household doors used in regions where the climate is relatively harsh in winter.

In the face of the increasing heating costs, it is becoming more and more important to reduce as much as possible the infiltration of air through doors and windows. It appears that one of the major sources of air infiltration is through the bottom of the principal doors of dwellings. It is therefore not surprising to note that there exist many ways of constructing outdoor door sills. The following American patents illustrate many models of door bottoms: Haskell, U.S. Pat. No. 926,409, June 29, 1909; Anderson, U.S. Pat. No. 1,768,730; Hehr et al, U.S. Pat. No. 2,795,015, June 11, 1957; Ghormley, U.S. Pat. No. 2,976,584, Mar. 28, 1961; and Coller, U.S. Pat. No. 4,055,917, Nov. 1, 1977. Despite this, the infiltration of air through the bottom of doors subsits because the door sill and the frame of all exterior doors have a tendency to shift once construction is finished.

SUMMARY OF THE INVENTION

We have discovered that it is possible to almost completely eliminate all infiltration of air through the bottom of an exterior door by using, as is shown in this invention, a floating door bottom whose position is perfectly adjusted to the sill of the door thereby allowing the weather strip placed between the bottom of the door and the top of the sill to play its role perfectly even many months after installation. This allows for the elimination of the storm door.

Thus, the weather-tight seal as shown in the present invention consists of a floating door bottom equipped with a rigid flange extending horizontally towards the bottom of the door panel, and a lower element fixed upon the door-sill and presenting a longitudinal groove into which the flange enters in order to position the bottom of the door to the lower element in relation with the parallelism and the spacing of these two pieces. The weather-tight seal also comprises a weather strip between the door bottom supporting it and the lower element, and a sufficient amount of free floating is allowed in the fastening of the door bottom to the lower end of the door panel, at least after adjustment of the door bottom with the door closed.

In a preferred embodiement, the door bottom is an extrusion made of plastic material which is a poor conductor of heat and having an upper part in U shape, the width of which corresponds to the thickness of the door frame and whose depth and means of fastening permit the door bottom to hang free in relation with the lower end of the door panel upon adjustment of the weather-tight seal. The element attached to the sill directly under the bottom of the door is, as well, an extrusion of plastic material which is a poor conductor of heat, and said element attached to this door sill comprises a front edge on the side of the opening of the door frame and it is on the top of this front edge that the longitudinal groove adapted to receive the flange of the bottom of the door is situated. The fixed element comprises, as well, the surface against which the weather strip comes in contact when the door is closed.

As well, one can provide, in the base of the upper part of the U shaped extrusion of the door bottom, a weather strip directed towards the top or, as well, a flexible flange upon which the lower end of the door will rest.

Figure 2:
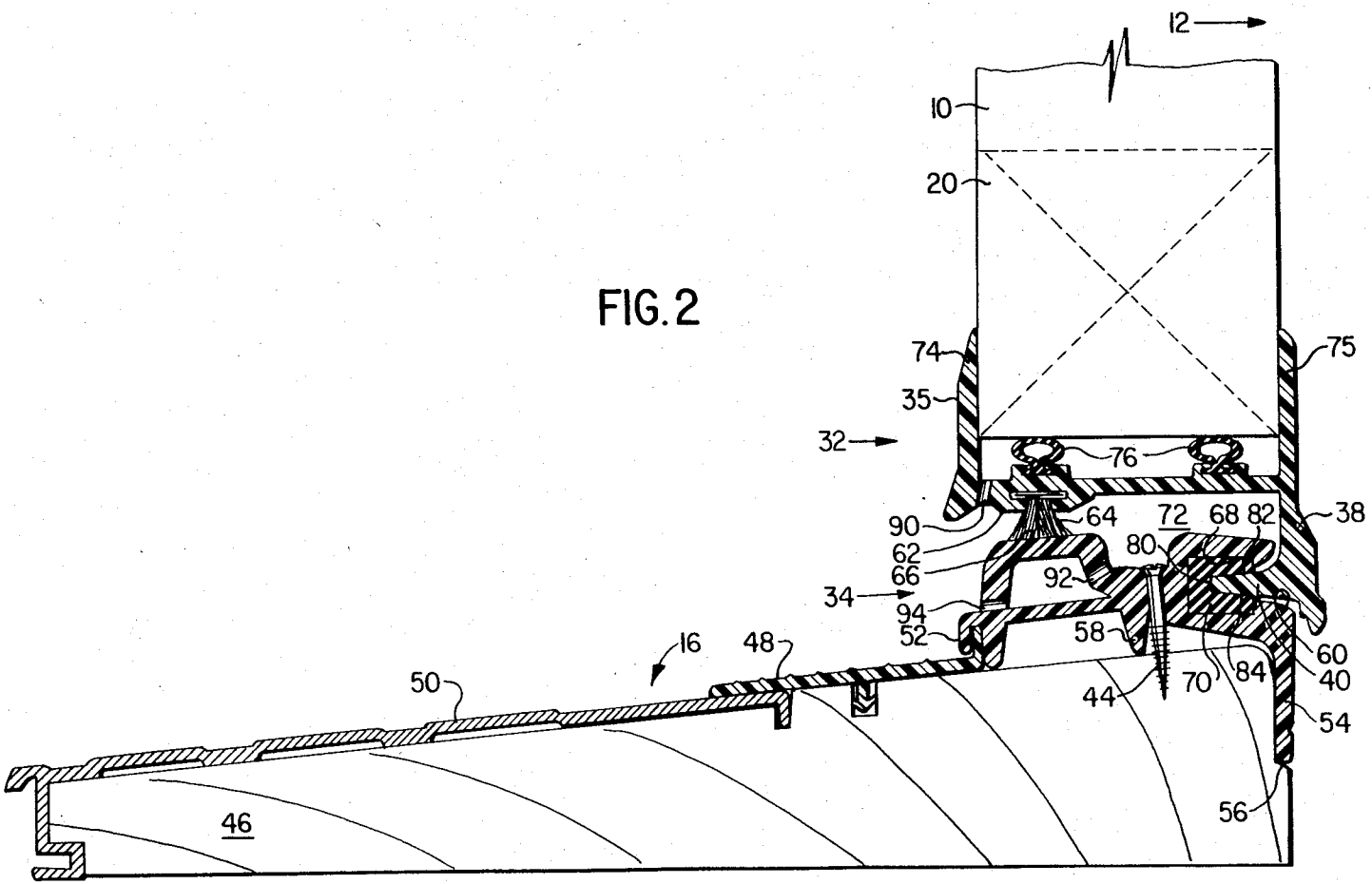

The other specifics of the proposed assembly will be more specifically described in a detailled description of a preferential embodiement of the invention, the same to be set forth hereafter by referring to the drawings annexed in which:

FIG. 1 is a partial view in perspective of a lower corner of a door showing the sill, the frame and part of the frame as well as a weather-tight seal embodied as per this invention, and FIG. 2 is a view of the weather-tight seal shown in FIG. 1.

On FIGS. 1 and 2 appears the door panel 10 of an exterior door supported by hinges that are not illustrated allowing door panel 10 to open in the direction of arrows 12 and 14 in relation with the sill 16 and the frame of the door shown in FIG. 1 at reference 18. Normally, the door panel 10 opens towards the interior of the dwelling and consequently the side that is exposed to the elements is the side shown at reference 20 in FIG. 2. However, as is apparent to the man of ordinary skill in the art, the present invention applies just as well to an outdoor door opening outwards.

A weather-tight seal is shown generally at reference 30, which comprises a first extrusion element 32 acting as a door bottom to door panel 10, a second extrusion element 34 attached to sill 16 directly under said first element 32 when the door is closed, as is shown in FIGS. 1 and 2. Elements 32 and 34 are essentially of the same length and extend from one end to the other of the door opening and each is of constant width and by preference they are made of an appropriate plastic material which is a poor conductor of heat, the purpose being to avoid condensation upon the parts of the weather-tight seal that are exposed to the interior of the dwelling in cold temperature. Each of elements 32 and 34 is by preference a single piece but one can envisage modes of construction using aluminium extrusions with thermal barriers as are well known in the art, although the cost of manufacture of such composite elements of aluminium are likely to be much higher than the cost of the elements shown in FIGS. 1 and 2.

The door bottom 32 seen in FIG. 2 consists of an upper portion 35 in U shape whose width corresponds to thickness of the lower end of door panel, and the depth of this portion in U shape must be sufficient to permit the attachment of the door bottom 32 to door panel 10 while still allowing a certain degree of floating as will be set forth in greater detail hereafter. In practice, this depth is in the order of 2 to 3 centimeters.

The door bottom 32 consists as well of a lower portions 38 that extends towards the bottom and carries a longitudinal flange guide 40 directed horizontally underneath the upper portion 35.

The second extrusion element 34 is attached to the sill 16 by an appropriate method, for example, wood screws 44 when the sill consists of a wood base 46. Upon the embodiement shown in Drawing 2, the sill 16 companies as well water barrier made of an extrusion 48 made of an appropriate thermal plastic and flooring 50, preferably comprising an aluminium extrusion and covering the exposed part of the base 46 of sill 16. The water barrier 48 serves as well as a base for the exterior part 52 of the fixed element 34. On the interior side of sill 16, the fixed element 34 comprises a frontal edge 54 whose extremity could be supported by a shoulder 56 carved into the wood-base 46. A central projection 58 constitutes the central axis of extrusion element 34.

The frontal edge 54 comprises as well a longitudinal groove 60 into which the flange 40 enters when the door is closed.

The door bottom 32 comprises as well a catch 62 for a weather strip 64 supported by a contact surface 66 which is the upper exterior part of the fixed extrusion element 34. The longitudinal groove 60 comprises as well a housing 68 whose shape is essentially square, and a felted band 70 open on one side which is placed in housing 68 to create a second means of imperviousness which is relatively removed from the weather strip fitting 64 which insures an air space 72 for better thermal insulation.

Within the U shape form 35 of door bottom 32, we provide two flexible tubular fittings 76 of well-known design resting against the lower end of door panel 10. These fittings may be made of any appropriate rubberized material such as neoprene. They act a little bit in the manner of a spring between the bottom of the door 32 and the door panel 10 and they are, as well, meant to prevent infiltration of air between these two components. The fastening of door bottom 32 to the lower end of door panel 10 must allow for a certain vertical displacement of the door bottom 32 in relation with door panel 10, and consequently, it is suggested that one uses two or three small wood screws such as screw 77 extending horizontally into the lower end of the door panel 10 passing through holes made in one or the other of flanges 74 and 75 of door bottom 32 such as hole 78 in flange 75. These holes must have a height sufficient to allow for the required mobility needed for a correct adjustment of door bottom 32. A play in order of one centimeter has been shown to be quite sufficient in practice.

As one can see by examining FIG. 2, the above-mentioned weather-tight seal comprises a floating door bottom 32 whose parallelism and spacing are prefectly determined by fixed element 34 due to the fact that the flange 40 enters the longitudinal groove 60, with very little play, when the door is closed. For these reasons, the flange 40 comprises a leading edge 80 of minimal height, and an upper surface 82 and a lower surface 84 which gradually move away from each other in a horizontal plane passing through the center of the flange 40 as they move away from the leading edge 80 and reach the lower portion 38 of the floating door bottom. This automatic adjustment of the position of the bottom of the door 32 allows the weather strip 64 to play its role perfectly without hindrance even many months after the installation of such a weather-tight seal. After this, the shifting of the frame 18 or the reltive displacement of sill 16 will have no negative effect upon the imperviousness of the weather-tight seal 30 because the bottom of the floating door 32 will gradually adjust itself in such a way as long as its means of fastening will allow relative movement between the bottom of the door 32 and the door panel 10, this being done automatically and gradually when one uses small wood screws for fastening, as mentioned above.

As well, one must provide drainage holes 90 on the exterior edge of door bottom 32 to permit the elimination of the condensation and water that may infiltrate between the door panel 10 and door bottom 32, and in, the same manner, one provides drainage holes 92 and 94 in the exterior region of the fixed extrusion 34.

The extrusions 32 and 34 are made from any appropriate thermal plastic material using well-known extrusion techniques. In a similar manner, the choice of the type of weather strip 64 and 70 is not critical, it being important to use extrusions 32 and 34 wherein the space above contact surface 66 is equivalent to the height of the weather strip 64 that is chosen.

While it is preferable to install the guiding flange 40 upon the bottom of the floating door bottom 32 rather than on the fixed extrusion 34 upon which the longitudinal groove 60 is found, one can easily imagine the reverse arrangement in which the groove would be found on the lower portion 38 of the bottom of the freely floating door while the guiding flange would be part of the fixed lower extrusion 34.

The use of a freely floating door bottom according to this invention with an insulated door panel, as for example, a steel door with rigid insulation, with good imperviousness provided between the frame and the door panel on the two sides and the top of the frame, allows the elimination of the form door even in those regions where winters are harsh.

I claim:

1. An improved threshold system for thermally insulating the lower end region of a domestic door comprising in combination:

a weather strip carrier extending along the lower edge of a door panel and relatively floatably connected thereto with a suitable degree of play for constant adjustment in the vertical direction, a generally horizontal weather strip wiping surface on the sill of the door directly below said weather strip carrier, a suitable weather strip extending along said weather strip carrier, securing means on said weather strip carrier to hold said weather strip to said weather strip carrier in a straight line directly above said weather strip wiping surface, and control means for automatically adjusting the floating height of said weather strip carrier above said weather strip wiping surface whenever said door panel assumes the closed position, said control means consisting of a substantial and close fitting tongue-and-groove engagement of said weather strip carrier with the sill of the door which engagement takes place upon closing of said door panel, whereby the floating distance between said weather strip wiping surface and said securing means and their parallelism are maintained independently of said weather strip and solely by virtue of said tongue-and-groove engagement.

2. An improved threshold system as defined in claim 1 wherein said weather strip carrier is made of plastic material and comprises a rigid arm extending downwardly below said weather strip wiping surface and an inwardly directed horizontal tongue rigidly secured to said arm, wherein said sill comprises a horizontally extending groove opening towards said tongue and closely conforming thereto, and wherein the strength and rigidly of said carrier are sufficient to cause constant vertical adjustment of said floating carrier relative to the height of said sill.

3. An improved threshold system as defined in claim 2 wherein said tongue tapers gradually on both sides towards its free edge, wherein said groove flares outwardly towards said tongue and comprises a cushioning seal for the free edge of said tongue which cushioning seal is spaced apart from said weather strip, and wherein said carrier is in the form of an upwardly opening channel receiving the lower edge of said door panel.

4. In combination:

a weather strip, a rigid channel weather strip carrier which is relatively floatably mounted to the lower edge of a door panel in a thermally insulated outside door for a dwelling and which supports said weather strip, and a wear plate for securing to the sill of said door directly below said door panel when same is closed, said carrier and said wear plate being thermally insulating, said wear plate comprising a generally horizontally extending wiping surface for said weather strip and a horizontal groove opening below said wiping surface along a generally vertical edge of said wear plate, said carrier also comprising securing means for supporting said weather strip directly above said wiping surface, rigid arm means extending generally downwardly and an inwardly directed horizontal tongue rigidly connected to said carrier via said arm means, said tongue being relatively long, tapering gradually towards its free edge and fitting closely within said groove when said door is closed, the strength and rigidity of said carrier being sufficient to cause automatic vertical adjustment of said floating carrier relative to the height of said wear plate when said tongue engages said groove whereby to continually set the distance between said securing means and said wiping surface independently of the forces which may be exerted by said weather strip upon said wiping surface.

5. The combination as defined in claim 4 wherein said weather strip is laterally spaced apart from the opening of said groove, wherein said groove supports a cushioning seal for the free edge of said tongue, and wherein the space between said wear plate and said carrier is confined along one edge by said weather strip and along the other edge by said cushioning seal thereby reducing heat losses through the space.

* * * * *